US011524520B2

(12) United States Patent
Wang et al.

(10) Patent No.: US 11,524,520 B2
(45) Date of Patent: Dec. 13, 2022

(54) CANVAS FLOCKING DIAMOND PICTURE

(71) Applicant: DIAMOND ART CLUB, LLC, Beverly Hills, CA (US)

(72) Inventors: Jinping Wang, Yiwu (CN); Alexandre Perrier, Los Angeles, CA (US)

(73) Assignee: DIAMOND ART CLUB, LLC, Beverly Hills, CA (US)

( * ) Notice: Subject to any disclaimer, the term of this patent is extended or adjusted under 35 U.S.C. 154(b) by 0 days.

(21) Appl. No.: 17/465,010

(22) Filed: Sep. 2, 2021

(65) Prior Publication Data

US 2021/0394550 A1 Dec. 23, 2021

Related U.S. Application Data

(60) Continuation of application No. 17/390,489, filed on Jul. 30, 2021, which is a division of application No. 16/284,688, filed on Feb. 25, 2019.

(30) Foreign Application Priority Data

Feb. 18, 2019 (CN) ..... 201920205215.5

(51) Int. Cl.
*B44C 1/00* (2006.01)
*D06C 7/02* (2006.01)
(Continued)

(52) U.S. Cl.
CPC ..... *B44C 1/00* (2013.01); *B44C 1/18* (2013.01); *B44C 3/02* (2013.01); *D06C 7/02* (2013.01);
(Continued)

(58) Field of Classification Search
CPC .... B44C 1/00; B44C 1/18; B44C 1/28; B44C 3/12–123; B44C 5/00; B44C 5/04;
(Continued)

(56) References Cited

U.S. PATENT DOCUMENTS 3,793,050 A 2/1974 Mumpower
3,917,883 A * 11/1975 Jepson ..... B05D 5/06 427/198
(Continued)

FOREIGN PATENT DOCUMENTS

CN 102874037 A 1/2013
CN 202685749 U 1/2013
(Continued)

OTHER PUBLICATIONS

"CN205022273_Machine Translation" is a machine translation of CN-205022273-U. (Year: 2016).*
(Continued)

*Primary Examiner* — Larissa Rowe Emrich
(74) *Attorney, Agent, or Firm* — KOS IP Law LLP

(57) ABSTRACT

The disclosure discloses a canvas flocking diamond picture, and relates to the technical field of canvas flocking diamond picture devices and making methods, solving the problem that the gray cloth of diamond canvas is shrunk after encountering water so that the diamond picture becomes uneven. The picture frame is internally provided with a protective film and a canvas, and the protective film is located at one side of the canvas; the upper end surface of the canvas is provided with a flash layer; an ink-receiving layer is arranged under the flash layer; an upper back cover layer is arranged under the ink-receiving layer; a cingico layer is arranged under the upper back cover layer; a lower back cover layer is arranged under the cingico layer; a flocking layer is arranged under the lower back cover layer, and the flocking layer is located on the lower end surface of the canvas; an adhesive layer is arranged between the lower back cover layer and the flocking layer.

11 Claims, 3 Drawing Sheets

(51) Int. Cl.

| | |
|---|---|
| ***D06P 5/04*** | (2006.01) |
| ***B44C 1/18*** | (2006.01) |
| ***B44C 3/02*** | (2006.01) |
| ***D06N 3/04*** | (2006.01) |
| ***D06M 23/08*** | (2006.01) |
| ***D06N 3/00*** | (2006.01) |
| *A47G 1/06* | (2006.01) |

(52) U.S. Cl.
CPC ..... *D06M 23/08* (2013.01); *D06N 3/0006* (2013.01); *D06N 3/042* (2013.01); *D06P 5/04* (2013.01); *A47G 1/06* (2013.01); *D06N 2203/041* (2013.01); *D06N 2211/12* (2013.01); *D06N 2213/03* (2013.01)

(58) Field of Classification Search
CPC ..... D06N 3/042; D06N 2203/041; D06N 2213/03; D06C 7/02
See application file for complete search history.

(56) References Cited

U.S. PATENT DOCUMENTS

| | | | | | |
|---|---|---|---|---|---|
| 3,922,410 | A | * | 11/1975 | Halloran | B05D 1/16 427/206 |
| 8,974,866 | B2 | | 3/2015 | Jorro De Inza | |
| 2018/0187369 | A1 | * | 7/2018 | Funke | D06M 15/423 |

FOREIGN PATENT DOCUMENTS

| | | | | |
|---|---|---|---|---|
| CN | 202986633 | U | | 6/2013 |
| CN | 203032271 | U | * | 7/2013 |
| CN | 103358798 | A | | 10/2013 |
| CN | 204020377 | U | | 12/2014 |
| CN | 204451799 | U | | 7/2015 |
| CN | 104816514 | A | | 8/2015 |
| CN | 104893440 | A | * | 9/2015 |
| CN | 204936659 | U | | 1/2016 |
| CN | 205022273 | U | * | 2/2016 |
| CN | 205022273 | U | | 2/2016 |
| JP | 2003175700 | A | * | 6/2003 |
| JP | 2003175700 | A | | 6/2003 |

OTHER PUBLICATIONS

"CN104893440_Machine Translation" is a machine translation of CN-104893440-A. (Year: 2015).*

"JP2003175700_Machine Translation" is a machine translation of JP-2003175700-A. (Year: 2003).*

"CN203032271_Machine Translation" is a machine translation of CN-203032271-U. (Year: 2013).*

Schwartz, Mel. (2016). Encyclopedia and Handbook of Materials, Parts, and Finishes (3rd Edition)—Bauschinger Effect. Taylor & Francis. Retrieved from https://app.knovel.com/hotlink/pdf/id:kt011YMZ72/encyclopedia-handbook/bauschinger-effect (Year: 2016).*

Hengameh Honarkar (2018) Waterborne polyurethanes: A review, Journal of Dispersion Science and Technology, 39:4, 507-516, DOI: 10.1080/01932691.2017.1327818 (Year: 2018).*

Farmer, Steven, and Jim Clark. "8.7: Acidity of Alcohols and Phenols." Chemistry LibreTexts, Libretexts, Aug. 11, 2020, https://chem.libretexts.org/Courses/University_of_Illinois_UrbanaChampaign/Chem_2363A_Fundamental_Organic_Chemistry_I_(Chan) (Year: 2020).*

Chinese Search Report for App. No. CN201920205215.5, dated Nov. 24, 2020, 4 pages.

* cited by examiner

CANVAS FLOCKING DIAMOND PICTURE

CROSS-REFERENCE TO RELATED APPLICATIONS

This application is a continuation application of U.S. patent application Ser. No. 17/390,489, filed on 2021 Jul. 30, which is a divisional application of U.S. patent application Ser. No. 16/284,688, filed on 2019 Feb. 25, which claims priority to Chinese Patent Application No. 201920205215.5 with a filing date of Feb. 18, 2019. The contents of the aforementioned applications, including any intervening amendments thereto, are incorporated herein by reference.

TECHNICAL FIELD

The disclosure relates to the technical field of canvas flocking diamond picture devices and making methods, and particularly relates to a canvas flocking diamond picture.

BACKGROUND OF THE PRESENT INVENTION

A diamond picture is called a DIY diamond picture, and its creativity origins from currently popular hand embroidered painting. A creative designer organically combines artificial crystal flat base round diamonds and excellently designed patterns, a painter only needs to adhere a diamond extracted by a diamond-adhering tool to a corresponding color spot on a canvas, thereby completing the pasting of one diamond. Then, each color region is slowly filled to finally form a picture inlaid with different color diamonds.

At present, the gray cloth of the diamond canvas on the market is shrunk after encountering water so that the diamond picture becomes uneven; meanwhile, the back surface of the diamond picture is mostly made of chemical fabric or cotton linen and the like so that wrinkles are generated, thereby affecting appearance and texture. Thus, it is urgent to develop a canvas flocking diamond picture on the market to help people to solve the existing problems.

SUMMARY OF PRESENT INVENTION

The objective of the disclose is to provide a canvas flocking diamond picture to solve the problem that the gray cloth of the diamond canvas is shrunk after encountering water so that the diamond picture becomes uneven, which is proposed in the above background.

In order to realize the above objective, the disclosure provides the following technical solution: a canvas flocking diamond picture comprises a picture frame, wherein, the picture frame is internally provided with a protective film and a canvas, and the protective film is located at one side of the canvas; the upper end surface of the canvas is provided with a flash layer; an ink-receiving layer is arranged under the flash layer; an upper back cover layer is arranged under the ink-receiving layer; a cingico layer is arranged under the upper back cover layer; a lower back cover layer is arranged under the cingico layer; a flocking layer is arranged under the lower back cover layer, and the flocking layer is located on the lower end surface of the canvas; an adhesive layer is arranged between the lower back cover layer and the flocking layer.

Preferably, the lower end surface of the upper back cover layer is attached to the upper end surface of the cingico layer.

Preferably, the lower end surface of the cingico layer is attached to the upper end surface of the lower back cover layer.

Preferably, the ink-receiving layer is fixedly connected with the upper back cover layer.

Preferably, a method for producing the canvas flocking diamond picture comprises the following steps:

step 1: wetting a cingico layer made of chemical fiber oxford cloth, then drying the wet cloth at a high temperature of 190° C. to take an effect of preventing shrinking and flatting the cloth surface, thereby completing sizing of gray cloth;

step 2: coating and sealing the holes and gaps on the back surface of the cingico layer with waterborne waterproof environmental-friendly acrylic acid to form the lower back cover layer;

step 3: uniformly brushing a layer of adhesive glue on the lower back cover layer to form an adhesive layer, and sufficiently paving woolens on the adhesive layer in a manner of spraying to form a flocking layer;

step 4: coating and sealing holes and gaps on the front surface of the cingico layer with waterborne waterproof environmental-friendly acrylic acid to form an upper back cover layer;

step 5: coating waterborne waterproof environmental-friendly acrylic emulsion on the surface of the upper back cover layer, and performing high-temperature temperature drying at a temperature of 150° C. to form a film, namely, an ink-receiving layer;

step 6: smearing paillettes on the ink-receiving layer to form a flash layer; and step 7: printing the patterns of the diamond picture on the flash layer, and smearing oily environmental-friendly glue at a place where the patterns are printed after printing.

Compared with the prior art, the disclosure has the beneficial effects:

1. Setting the step of wetting and drying the gray cloth of the canvas flocking diamond picture takes an effect of preventing the gray cloth from being shrunk and solves a problem that the gray cloth of the diamond canvas is shrunk when encountering water so that the diamond picture becomes uneven, thereby improving the appearance of the diamond picture.

2. Setting of spraying glue and flocking the canvas flocking diamond picture achieves a gain effect of resisting wrinkle and preventing wrinkle, improves the appearance and texture of the diamond canvas, effectively maintains the appearance of the diamond picture, avoids that the diamond canvas forms wrinkles due to stacking and wrinkling when in transportation, and solves a problem that the back surface of the diamond picture is most made of chemical fiber cloth or cotton linen so that wrinkles are generated, thereby affecting the appearance and texture.

3. The in-receiving layer is arranged on the canvas flocking diamond picture to absorb ink sprayed from a printer so as to allow patterns to be quickly dried, thereby greatly shortening the time of drying the ink in the air and effectively preventing ink change caused by light rubbing of hands of a worker; meanwhile, the ink-receiving layer allows the effect of the diamond picture to be better and makes color restoration more real.

In drawings, 1, picture frame; 2, protective film; 3, canvas; 4, flash layer; 5, ink-receiving layer; 6, upper back cover layer; 7, cingico layer; 8, lower back cover layer; 9, adhesive layer; 10, flocking layer.

DETAILED DESCRIPTION OF PREFERRED EMBODIMENTS

Next, the technical solution in embodiments of the disclosure will be clearly and completely described in combination with drawings in embodiments of the disclosure, apparently, the described embodiments are only one part of embodiments of the disclosure but not all the embodiments.

Figure 1:
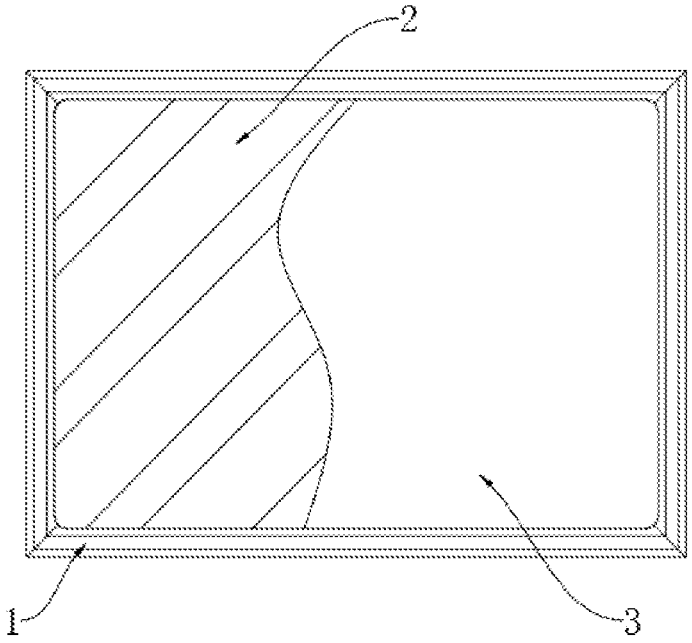
FIG. 1 is a front view of a canvas flocking diamond picture according to the disclosure.
Figure 2:
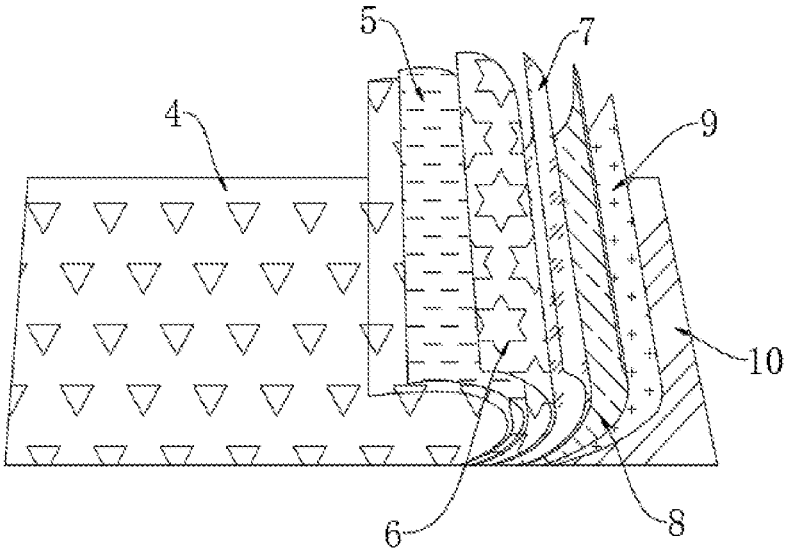
FIG. 2 is a structural diagram of a canvas flocking diamond picture according to the disclosure.
Figure 3:
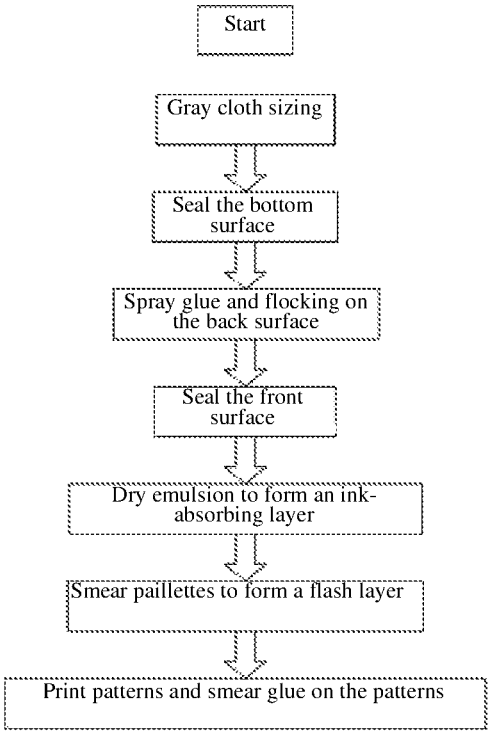
FIG. 3 is a structural diagram of a flowchart of use method steps according to the disclosure.

Referring to FIGS. 1-3, an embodiment provided by the disclosure is as follows: a canvas flocking diamond picture comprises a picture frame 1, wherein, the picture frame 1 is internally provided with a protective film 2 and a canvas 3, and the protective film 2 is located at one side of the canvas 3; the upper end surface of the canvas 3 is provided with a flash layer 4; an ink-receiving layer 5 is arranged under the flash layer 4; an upper back cover layer 6 is arranged under the ink-receiving layer 5; a cingico layer 7 is arranged under the upper back cover layer 6; a lower back cover layer 8 is arranged under the cingico layer 7; a flocking layer 10 is arranged under the lower back cover layer 8, and the flocking layer 10 is located on the lower end surface of the canvas 3; an adhesive layer 9 is arranged between the lower back cover layer 8 and the flocking layer 10.

Further, the lower end surface of the upper back cover layer 6 is attached to the upper end surface of the cingico layer 7.

Further, the lower end surface of the cingico layer 7 is attached to the upper end surface of the lower back cover layer 8.

Further, the ink-receiving layer 5 is fixedly connected with the upper back cover layer 6.

Further, a method for producing the canvas flocking diamond picture comprises the following steps:

step 1: after wetting a cingico layer 7 made of chemical fiber oxford cloth, drying the wet cloth at a high temperature of 190° C. to take an effect of preventing shrinking and flatting the cloth surface, thereby completing the sizing of gray cloth;

step 2: coating and sealing holes and gaps on the back surface of the cingico layer 7 with waterborne waterproof environmental-friendly acrylic acid to form a lower back cover layer 8;

step 3: uniformly brushing a layer of adhesive glue on the lower back cover layer 8 to form an adhesive layer 9, and paving woolens on the adhesive layer 9 in a manner of spraying to form a flocking layer 10;

step 4: coating and sealing holes and gaps on the front surface of the cingico layer 7 with waterborne waterproof environmental-friendly acrylic acid to form an upper back cover layer 6;

step 5: coating waterborne waterproof environmental-friendly acrylic emulsion on the surface of the upper back cover layer 6, and drying at a high temperature of 150° C. to form a film, namely, an ink-receiving layer 5;

step 6: smearing paillettes on the ink-receiving layer 5 to form a flash layer 4; and step 7: printing the patterns of the diamond picture on the flash layer 4, and smearing oily environmental-friendly glue at a place where the patterns are printed after printing.

It is apparent for those skilled in the art that the disclosure is not limited to details of the above exemplary embodiment and can be achieved in other particular forms without departing from the spirit or basic features of the disclosure. Thus, regardless of which points, embodiments should be deemed as being exemplary and non-limiting. The scope of the disclosure is defined by appended claims rather than the above description, and therefore it is intended that all changes coming within the meanings and scope of equivalent elements of claims are included in the disclosure. Any reference numbers in claims should not be considered as limiting the involved claims.

We claim:

1. A method for producing a canvas diamond picture, comprising:

providing a canvas defining a first side and a second side opposite the first side;

wetting a chemical fiber oxford cloth layer arranged on a first side of the canvas;

after wetting the chemical fiber oxford cloth layer, drying the chemical fiber oxford cloth layer at a temperature of 190° C. to mitigate shrinking and flatting a surface of the chemical fiber oxford cloth layer;

coating and sealing holes and gaps on a back surface of the chemical fiber oxford cloth layer with waterborne waterproof acrylic acid to form a lower back cover layer;

uniformly brushing a layer of adhesive glue on the lower back cover layer to form an adhesive layer;

attaching a fibrous layer to the adhesive layer on the second side of the canvas opposite the first side of the canvas;

coating and sealing holes and gaps on a front surface of the chemical fiber oxford cloth layer with waterborne waterproof acrylic acid to form an upper back cover layer;

coating waterborne waterproof acrylic emulsion on the upper back cover layer, and performing drying at a temperature of 150° C. to form an ink-receiving layer;

forming a flash layer on the ink-receiving layer;

printing patterns of a picture on the flash layer; and smearing oily glue at a place where the patterns are printed after printing.

2. The method of claim 1, further comprising of attaching a lower end surface of the upper back cover layer to an upper end surface of the chemical fiber oxford cloth layer.

3. The method of claim 1, further comprising attaching a lower end surface of the chemical fiber oxford cloth layer to an upper end surface of the lower back cover layer.

4. The method of claim 1, further comprising fixedly connecting the ink-receiving layer with the upper back cover layer.

5. The method of claim 1, wherein attaching the fibrous layer to the adhesive layer includes spraying woolen on the adhesive layer to form a flocking layer.

6. The method of claim 1, further comprising providing the fibrous layer as a flocking layer.

7. A method for producing a canvas diamond picture, comprising:

providing a canvas defining a first side and a second side opposite the first side;

wetting a chemical fiber oxford cloth layer arranged on a first side of the canvas;

after wetting the chemical fiber oxford cloth layer, drying the chemical fiber oxford cloth layer to mitigate shrinking and flatting a surface of the chemical fiber oxford cloth layer;

coating and sealing holes and gaps on a back surface of the chemical fiber oxford cloth layer with waterborne waterproof acrylic acid to form a lower back cover layer;

brushing a layer of adhesive glue on the lower back cover layer to form an adhesive layer;

attaching a fibrous layer to the adhesive layer on the second side of the canvas opposite the first side of the canvas;

coating and sealing holes and gaps on a front surface of the chemical fiber oxford cloth layer with waterborne waterproof acrylic acid to form an upper back cover layer;

coating waterborne waterproof acrylic emulsion on the upper back cover layer, and performing drying at a temperature of 150° C. to form an ink-receiving layer;

smearing paillettes on the ink-receiving layer to form a flash layer; and printing patterns of a picture on the flash layer; and smearing oily glue at a place where the patterns are printed after printing.

8. The method of claim 7, further comprising attaching a lower end surface of the upper back cover layer to an upper end surface of the chemical fiber oxford cloth layer.

9. The method of claim 7, further comprising attaching a lower end surface of the chemical fiber oxford cloth layer to an upper end surface of the lower back cover layer.

10. The method of claim 7, further comprising fixedly connecting the ink-receiving layer with the upper back cover layer.

11. The method of claim 7, wherein attaching the fibrous to the adhesive layer includes spraying woolen on the adhesive layer to form a flocking layer.

* * * * *